United States Patent [19]

Rose, Jr.

[11] Patent Number: 4,687,226

[45] Date of Patent: Aug. 18, 1987

[54] DEVICE FOR SUPPORTING BOUND MATERIAL

[76] Inventor: Robert D. Rose, Jr., Communications Packaging Corporation, 2635 S. Santa Fe Dr., Denver, Colo. 80223

[21] Appl. No.: 883,616

[22] Filed: Jul. 9, 1986

Related U.S. Application Data

[63] Continuation-in-part of Ser. No. 734,959, May 16, 1985, abandoned.

[51] Int. Cl.[4] ..... B42D 17/00; B42D 1/00; A47B 23/00

[52] U.S. Cl. ..... 281/45; 281/20; 248/441.1

[58] Field of Search ..... 281/20, 36, 42, 45; 248/441.1, 442.2; 40/159; 206/328; 434/429

[56] References Cited

U.S. PATENT DOCUMENTS

| | | | |
|---|---|---|---|
| 763,554 | 6/1904 | Greene | 281/20 |
| 1,021,832 | 4/1912 | Fletcher | 281/20 |
| 1,337,612 | 4/1920 | Miller | 281/20 |
| 1,681,586 | 8/1928 | Kessler | 248/441.1 |
| 2,570,397 | 10/1951 | Slonneger | 281/45 |
| 2,657,072 | 10/1953 | Harrington | 281/20 |
| 2,774,615 | 12/1956 | Joseph | 281/20 |
| 3,272,183 | 9/1966 | Craighead et al. | 248/441.1 |
| 4,524,991 | 1/1985 | Thomas | 281/20 |

*Primary Examiner*—Donald R. Schran
*Assistant Examiner*—Paul M. Heyrana, Sr.
*Attorney, Agent, or Firm*—Gregg I. Anderson

[57] ABSTRACT

A support device for bound materials, such as a notebook binder holding pages of computer software documentation, holds the bound materials in two distinct positions. In a first position, front and back covers, along free edges thereof, are received by slots in the support device which hold the front and back covers in a substantially parallel position to each other. The support device is otherwise essentially open so that the entire spine and substantially all of the front and back covers are easily seen. In a second position, one side of the support device includes a pair of angled notches formed therein which receive lower free edges of the front and back covers. Turning the support device onto its other side allows the user of the device to place the binder in the second position, supported in the notches in an open, raised or easel position for easy access and use.

7 Claims, 9 Drawing Figures

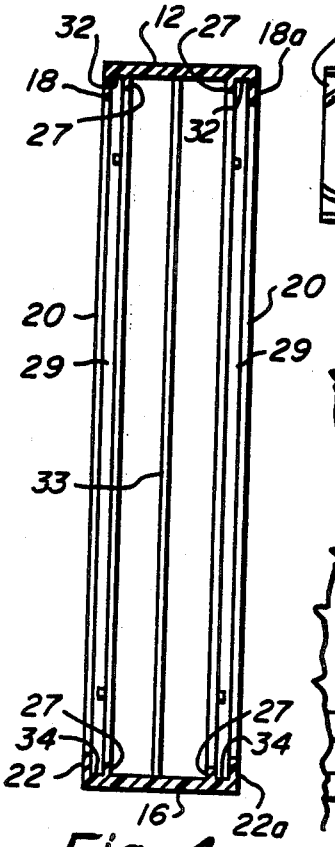
Fig_4
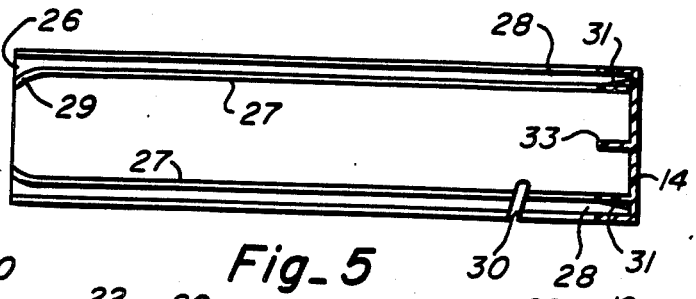
Fig_5
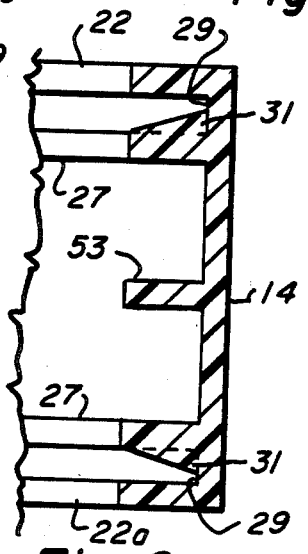
Fig_6
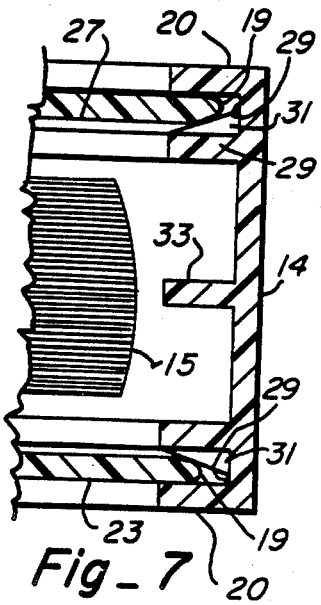
Fig_7
Fig_8
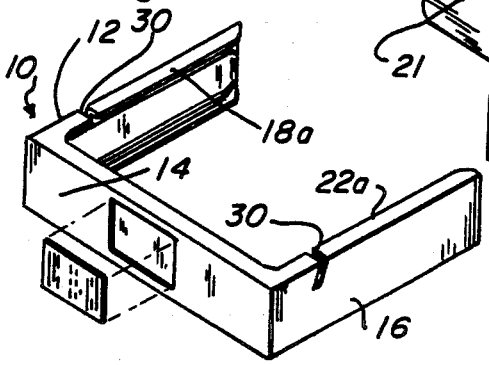
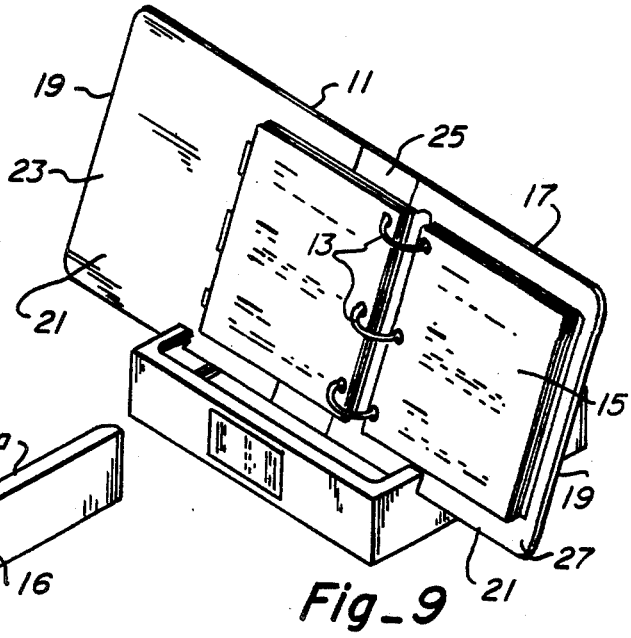
Fig_9

DEVICE FOR SUPPORTING BOUND MATERIAL

CROSS REFERENCE TO RELATED APPLICATION

This reference is a continuation in part of copending U.S. patent application Ser. No. 734,959 filed May 16, 1985, abandoned.

BACKGROUND OF THE INVENTION

1. Field of the Invention

The present invention relates to devices for storing and protecting loose leaf pages held in a notebook binder or pages of a bound book. More particularly, the present invention relates to storage and retention of binders for written documentation and computer disks used while operating computer programs stored on the [floppy] computer disks.

2. Description of the Prior Art

As presently marketed and sold, most computer programs for business and home use include two separate parts, characterized as computer software. The first part is a magnetic medium on which a computer program is imprinted in a machine readable form. The magnetic medium, a computer or floppy disk in the case of most microcomputers, is read by the computer and loaded into computer memory. Once loaded, the program can be executed by the computer upon instructions supplied by the computer user.

The second part of computer software is written instructions used as a reference by the computer user, describing how to execute various functions of the program. These written instructions, or documentation, often in the form of loose leaf pages, are typically held in a standard three ring notebook binder including an outer cover and a retainer ring assembly, which assembly includes snap rings that open and close to receive new pages updating the written instructions. The notebook binders vary as to the amount of pages they hold. Often plastic sleeves for the floppy disks are provided, which have holes to allow the user to keep the plastic sleeves secured in the binder by the rings, along with the written instructions.

The binder or book needs support in order to be shelved as one would shelve a book. Prior support devices are simply plastic, paper or linen bound slipcases which are open box-like structures which receive the binder and completely cover it leaving only the spine of the binder visible. Once sheathed in the slipcases, the binder or book can easily be shelved for storage and later reference. The slipcase further functions as a protection from dust that may damage any disks stored in the binder.

Though they are convenient, the prior art slipcases are intensive in their use of material, and therefore expensive, the entire book or binder being completely covered but for the spine. While the computer user is making reference to the pages of documentation, the slipcase is useless and must be placed somewhere out of the way. The slipcase also completely obscures any viewing of the front cover of the binder or book, which often has printed information applied thereto.

A binder for loose leaf documentation and computer disks, which displays the documentation pages, is seen in U.S. patent application Ser. No. 575,898 for Notebook for Storage of Computer Disks and Loose Leaf Documentation, the invention having common inventorship with the present invention.

Various storage cases for magnetic or floppy disks alone have heretofore been known. Examples are various patents issued to R. Egley, U.S. Pat. Nos. 4,225,038 and 4,369,879 as well as Des. Pat. No. 251,273. It is also known to store magnetic disks in thermo-formed containers, as seen in U.S. Pat. No. 3,864,755 to J. Hargis.

Composite loose leaf binders for storing written instructional materials and electronic components are seen in J. Gallaher, Jr., U.S. Pat. No. 4,157,757. Gallaher also shows compartments that can be released from the binder. Binders for storing electronic components are also seen in J. Cooper, U.S. Pat. No. 4,274,537.

A two-compartment binder is seen in U.S. Pat. No. 4,259,799 to R. Fulton, Jr. One compartment receives a notebook and the other compartment receives plastic frames. U.S. Pat. No. 3,837,680 to P. Cimini shows an overlay cover or leaf in connection with a loose leaf notebook binder which separates documents into two different binders.

Easel-type binders are seen in K. Crawford, U.S. Pat. No. 4,355,821; J. O'Brien, U.S. Pat. No. 4,033,652 and E. Petersen, U.S. Pat. No. 3,682,433. An easel binder showing a notebook that can be inserted into another notebook is seen in U.S. Pat. No. 3,913,740 to A. Bisberg.

An easel-type binder commercially available built along the principal shown in Crawford is also known. The commercially available binder has a fold line in the cover transverse to the binder ring assembly. The cover is folded back to form an angle which supports the ring assembly at a raised or easel position.

OBJECTS AND SUMMARY OF THE INVENTION

It is the principal object of the present invention to provide a support device selectively secured to a loose leaf notebook binder or bound book which uses a minimum of material to support the binder so it can be easily shelved like a book.

It is a related object of the present invention to provide a support device selectively secured to a loose leaf notebook binder or bound book that allows easy visual reference to the front and back covers of the binder as well as the spine.

It is another object of the present invention to provide a support device for use with a loose leaf notebook binder or bound book which is convertible, when not being used to support and shelve or store the binder or book, to support the binder or book in an open raised or easel position for easy reference to the pages retained therein.

In accordance with the objects of the invention, a support device for a notebook binder or book, hereinafter reference made only to the binder, is selectively connectable to the binder along three free edges of front and back covers, holding the front and back covers parallel to each other. This support device is open so that substantially all of the front and back covers, as well as a spine interconnecting the front and back covers, are easily seen when the support device is connected to the binder.

The support device is constructed of upper and lower members interconnected by an integral spine member, the three members extending around the free edges at the periphery of the binder cover and include interior mating slots for receipt of and positioning of the free edges of the front and back cover.

Connection of the support device to the notebook binder as just described, defines a first closed or support position. In the first closed or support position the notebook binder and mated support device form an essentially rigid structure which is easily shelved, in a manner as a conventional book. In the closed position, wherein the support device is matingly connected to the notebook binder, the entire interconnected structure rests upon the lower member of the support device and is stable in a generally upright position.

The upper and lower members include like support notches formed in one side of the support device for slideable engagement with a bottom free edge of both of the front and back covers. Once the front and back covers are engaged in the support notches of the upper and lower members, the support device is laid on its other side on a supporting surface so that the notebook binder is held at a second open raised or easel position. In the second position, the support device holds the binder open for reference to the written pages therein.

DESCRIPTION OF THE DRAWINGS

FIG. 4 is a sectional view taken in the plane of line 4—4 of FIG. 3.

FIG. 5 is a sectional view taken in the plane of line 5—5 of FIG. 3.

FIG. 6 is an enlarged fragmentary sectional view taken in the plane of line 6—6 of FIG. 3.

FIG. 7 is an enlarged fragmentary sectional view taken in the plane of line 7—7 of FIG. 2.

FIG. 8 is a perspective view of the support device shown in FIG. 1 laying horizontally on one side.

FIG. 9 is a view similar to FIG. 8, the notebook binder shown connected to the support device in a second open position.

DESCRIPTION OF THE PREFERRED EMBODIMENT

Figure 1:
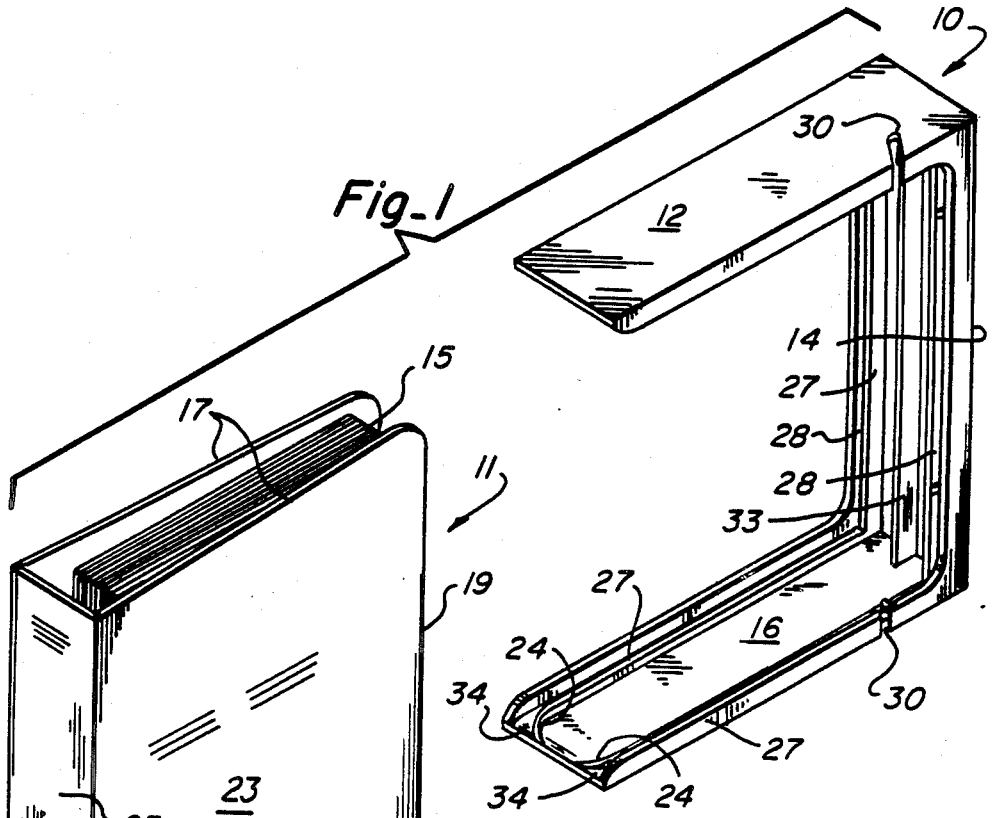
FIG. 1 is a perspective view of a support device of the present invention, a notebook binder used in conjunction with the present invention shown adjacent thereto.
Figure 2:
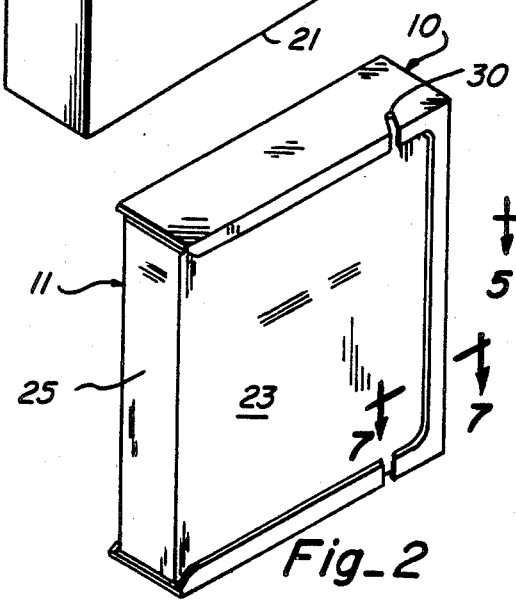
FIG. 2 is a perspective view of the support device and notebook binder matably connected in a first closed support position.

A support device 10 is seen in FIGS. 1 and 2 to matingly connect to bound material, a conventional loose leaf notebook binder 11 or book being shown, in a first closed support position. (FIG. 2). Hereinafter, the device will be described by reference to the binder only. In the first position, loose leaf pages 15 and plastic sleeves holding computer or floppy disks (not shown) held by rings 13 (FIG. 9) of a snap ring assembly are protected from dirt and other possibly damaging elements. The matingly connected support device 10 and binder 11 can be shelved in an upright position as one would with a book.

As best seen in FIG. 9, the support device 10 is laid horizontally, on one side, for reference to the pages 15 held in the notebook binder 11. Support notches 30 formed on another side of the support device 10 receive lower edges 21 of front and back covers 23 and 27 of the notebook binder 11. This second open easel position is particularly useful for displaying the contents of the notebook binder 11, the loose leaf pages 15 comprising documentation and instruction for a computer program. In using a computer program, it is normally advantageous for the user to have both hands free for operating a computer keyboard (not shown). With the hands free, the easel position shown in FIG. 9 permits visual reference to the loose leaf pages 15 retained by the snap rings 13 in the notebook binder 11.

In all respects, the notebook binder 11 shown is of conventional commercially available construction in which computer software documentation is sold or later placed. The front and back covers 23 and 27 are interconnected by a spine 25 along a pair of hinge lines about which the covers 23 and 27 pivot to open or close the binder 11. The three rings 13 are standard snap rings secured by any conventional means to the spine 25 or one of the covers 23 or 27.

Figure 3:
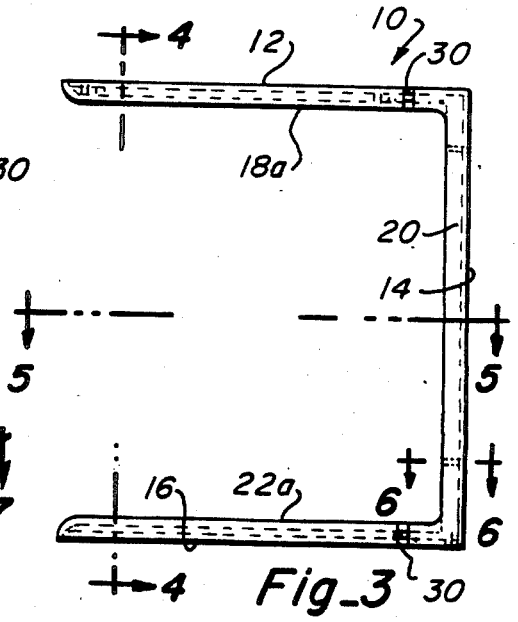
FIG. 3 is a side elevational view of the support device shown in FIG. 1.

The support device 10 is preferably integrally constructed, as by a molding process, of a high-strength yet flexible plastic. Generally flat planar upper and lower members 12 and 16 are interconnected by a like flat planar spine member 14 to define the support device 10 as a generally C-shaped cover (FIG. 3) for the binder 11 having an opening into which the notebook binder 11 is inserted as seen in FIG. 1. In the first position of FIGS. 1 and 2, upper free edges 17 of the covers 23 and 27 mate with the upper member 12, as will be described. Forward free edges 19 of the covers 23 and 27 are frictionally held by grasping means in the support device 10 near the spine member 14. (FIG. 7). The bottom free edges 21 mate with the lower member 16 in a like manner.

As best seen in FIG. 4, the upper member 12 includes two longitudinally extending outer retainer walls 18 and 18*a*. Wall 18*a* differs from wall 18 in that the notch 30 is formed through wall 18*a*. The spine member 14 includes a pair of parallel outer retainer walls 20 extending vertically between the upper member 12 and lower member 16. In identical configuration to the upper retainer walls 18 and 18*a*, the lower member 16 includes outer retainer walls 22 and 22*a*.

Intermediate the walls 18 and 18*a* of the upper member 12 and the walls 22 and 22*a* of the lower member 16, flat surfaces 32 and 34 are respectively defined. The distance between the surfaces 32 and 34 is essentially the same as the height of the binder 11 between upper edges 17 and lower edges 21. Insertion of the covers 23 and 27 of the binder 11 into the support device 10 between the outer retainer walls 18, 18*a*, 20, 22 and 22*a* results in the support device circumscribing the binder 11, as seen in FIG. 2. The angle at which the upper member 12 and lower member 16 make with the spine member 14 (FIG. 3) is preferably slightly less than 90° so that the upper and lower members grasp the binder upon insertion of the binder 11 and interconnection with the device 10.

Means for spreading the front and back covers 23 and 27 of the binder 11 is seen to be an inwardly turned guide 24 integrally formed on and raised slightly above the surfaces 32 and 34. (FIGS. 1 and 5). The guide 24 defines an open mouth 26 on the surfaces 32 and 34 to receive the front edge 19 where it intersects edges 17 and 19. As the binder 11 is inserted into the mouth 26, the front and back covers 23 and 27 are spread open and aligned so as to be parallel with the planes containing the walls 18, 18*a*, 20, 22, and 22*a*. (FIGS. 2 and 7).

The guide 24 makes a smooth transition to integrally connect to an inner retainer wall 27 extending parallel to outer retainer walls 18*a*, 18, 22*a* and 22. (FIGS. 1 and 5). The retainer walls 27 are low enough that they do not interfere with the pages 15 as the covers 23 and 27 of the binder 11 are inserted along the surface 34 between the walls 22 and 27 and 27 and 22*a* respectively.

The wall 27 also extends parallel to the retainer walls 20 the entire height of the spine member 14, along an interior surface 29 of the spine member 14. Between the inner wall 27 and the retainer walls 18, 18*a*, 22, 22*a* and 20 is defined a mating slot 28 which receives therein the edges 17, 19 and 21 of the binder 11. The mating slot 28 includes a wedge 31 found along a portion of the surface 29, 5, 6 and 7. The wedge 31 gradually tapers to the point where a thin cross section of the slot 28 is presented to grasp a portion of the edge 19 and secure the binder 11 to the support device 10. Finally, a structural member 33 is shown connected to the spine 14 to enhance the strength of the device 10.

When it is desired to display and use the loose leaf pages 15 of the binder 11, the binder is removed from the support device 10. The support device is placed on the one side on a work surface so that retainer walls 18, 20 and 22 rest thereon. The notches 30, which make an angle with the other side of approximately 60°, are thereby accessed. The binder 11 is opened and the bottom edge 21 of the front and back covers 23 and 27 is inserted into the two notches 30 on the other side of the support device 10. (FIG. 9). The binder 11 is held in an open position, at an angle of approximately 60°, and the pages 15 are easily accessed. The user of a computer may work at the keyboard while simultaneously viewing user documentation printed on the pages 15.

Although the invention has been described with a certain particularity, the scope of the invention is set out in the appended claims.

What is claimed is:

1. A support device for bound materials including a cover, said cover having front and back covers interconnected by a spine, said device, comprising in combination:

a generally C-shaped cover, including a top member, spine member and lower member, each of said members having parallel slots formed therein for receiving free edges of said front and back covers and for holding said front and back covers in a pre-established, fixed position wherein said materials are completely enclosed and said covers are positioned by said slots essentially parallel to each other, said mating slots of said upper and lower members formed by an outer wall and an inner wall, at least one of said inner walls including an integral guide surface, formed at an opening of said C-shaped cover, said guide surface defining an enlarged open mouth for receipt of said free edges and for spreading the covers and directing them down the slots.

2. The invention as defined in claim 1 wherein each of said upper and lower members define an angle of slightly less than 90° with said spine member.

3. The invention as defined in claim 1 wherein a side of each of said upper and lower members includes a notch formed therein for receipt of said bottom edges of said covers, whereby a horizontal orientation of said support device allows said binder to be inserted in said notches and held in an open, raised position.

4. A support device for a notebook binder retaining looseleaf pages on the ring assembly, said binder including front and back covers interconnected by a spine, to one of which said covers or spine the ring assembly connected, said support device including means for receiving and rigidly holding said covers and said pages in a pre-established position, said means for receiving said covers slideably mated to free edges of said front and back covers, said means for receiving said cover further including an enlarged, open mouth for spreading each of said front and back covers to a position wherein said front and back covers are substantially parallel to each other for mating connection between said free edges and said support device, some of said slots tapering to a minimum width whereby said slots grasp the forward edges of said front and back covers.

5. A support device for a notebook binder having a cover, said cover including a front cover interconnected by a spine to a back cover, said binder further having retention rings connected to said cover for releasably retaining looseleaf pages, said support device being of generally C-shaped configuration including three intersecting straight planar members, an upper member interconnected to a lower member by a spine member, a slot formed along two sides of at least a portion of the length of each of the three said members for mating receipt of corresponding edges of the front and back covers of said binder, said slots tapering to a minimum width to grasp said cover.

6. The invention as defined in claim 5 wherein said suport device further includes on the interior surfaces of said upper and lower members an enlarged, open mouth for spreading said cover to a position wherein said front and back covers are substantially parallel to each other.

7. The invention as defined in claim 6 wherein said mouth is defined by an angled guide surface extending a relatively short height above said interior surfaces of said upper and lower members.

* * * * *